United States Patent [19]

Stern et al.

[11] 4,428,148

[45] Jan. 31, 1984

[54] INERTIA FLYWHEEL DRIVE MECHANISM FOR A TOY VEHICLE

[75] Inventors: Carl M. Stern, East Aurora; William M. Maher, Churchville; Michael T. Ventre, Blasdell, all of N.Y.

[73] Assignee: The Quaker Oats Company, Chicago, Ill.

[21] Appl. No.: 346,163

[22] Filed: Feb. 5, 1982

[51] Int. Cl.[3] ..... A63H 33/30; A63H 29/20

[52] U.S. Cl. ..... 46/40; 46/209; 46/212

[58] Field of Search ..... 46/40, 206, 209, 212, 46/214, 208

[56] References Cited

U.S. PATENT DOCUMENTS 991275 5/1911 Clark ..... 46/209 X

FOREIGN PATENT DOCUMENTS 694084 7/1940 Fed. Rep. of Germany ..... 46/206
1043176 11/1958 Fed. Rep. of Germany ..... 46/209
1092824 11/1960 Fed. Rep. of Germany ..... 46/40

*Primary Examiner*—Mickey Yu
*Attorney, Agent, or Firm*—Gumpston & Shaw

[57] ABSTRACT

A toy vehicle having a drive wheel and winch driven by an inertia flywheel. The winch has a winch drum that winds a cord attached thereto in only one direction of rotation of the drum. A double detent mechanism precisely positions the winch transmission in its neutral position. A fixed gear tooth brakes or locks the winch drum when the winch transmission is in its neutral position.

A drive transmission for selectively driving the drive wheel to cause the vehicle to move in a forward or a reverse direction.

12 Claims, 7 Drawing Figures

INERTIA FLYWHEEL DRIVE MECHANISM FOR A TOY VEHICLE

BACKGROUND OF THE INVENTION

1. Field of the Invention

This invention relates to toy vehicles, and particularly to an improved inertia flywheel drive mechanism for a toy vehicle.

2. Description of the Prior Art

Toy vehicles are known which are driven by the inertia of a rotating flywheel. Such toy vehicles generally employ a single gear train coupling the flywheel to the drive wheel shaft. Accordingly, the toy vehicle moves forward when the flywheel is rotated in one direction by the friction between the floor and wheels of the vehicle. The toy vehicle moves backward when the flywheel is rotated in the opposite direction by moving the vehicle backward on the floor.

The prior art is further replete with drive mechanisms for toy vehicles of which the following patents are representative: U.S. Pat. No. 806,977, Kingsbury; U.S. Pat. No. 3,546,809, Nielsen; U.S. Pat. No. 3,798,831, Higashi; U.S. Pat. No. 3,919,804, Nokata; U.S. Pat. No. 4,059,918, Matsushiro; U.S. Pat. No. 4,130,963, Ohashi and Fr. Pat. No. 1,394,867, Mathiot.

SUMMARY OF THE INVENTION

In accordance with the present invention, an inertia flywheel drive mechanism is disclosed for driving a drive wheel and winch. The winch has a winch drum for winding a cord attached thereto in only one direction of rotation of the drum. A double detent means is provided for precisely positioning the winch and drive wheel transmissions in their neutral positions. A fixed gear tooth is further provided for braking or locking the winch drum when the winch transmission is in its neutral position.

In a more specific aspect of the invention, the winch drum has a core having a radially extending shoulder on its periphery for engaging a knot on the cord encircling the core when the drum is rotated in the one direction.

In another more specific aspect of the invention, the double detent means comprises detent mechanisms on the winch and drive wheel transmissions and separate detent mechanisms on the shift levers for locating only the neutral positions of the transmissions.

In still another more specific aspect of the invention, the fixed gear tooth engages a gear on the winch transmission when the winch transmission is in its neutral position to prevent unwinding of the winch drum.

In winch mechanisms in which a cord has one end secured to a winch core, the cord will unwind returning an object at the other end of the cord to its outermost position upon rotation of the core in one direction. However, continued rotation of the core in the one direction when the end of the core is reached results in winding the cord in the opposite direction. Accordingly, instead of the object remaining in its outermost position as desired, it is pulled toward the winch drum which is objectionable. This problem is solved in this invention by attaching one end of the cord around the core with a knot and providing a radially extending shoulder on the core that slips over the knot upon continued rotation of the core in the one direction when the end of the cord is reached. Accordingly, the object remains in its outermost position during such continued rotation of the core in its one direction. Upon rotation of the core in its opposite direction, the shoulder engages the knot and winds the cord for pulling the object toward the core.

In toy vehicles having a gear train transmission movable by a shift lever between drive, reverse and neutral positions, a detent mechanism may be provided on the transmission for releasably holding the transmission in the wind or drive, unwind or reverse and neutral positions. However, the force arm for the shift lever greatly exceeds the force arm for the transmission detent mechanism such that it is difficult for a child to feel when the transmission is in a selected neutral position. As a result, misplacement or overshooting of the transmission occurs which is objectionable to an operator of the toy vehicle. This problem is solved in this invention by placing a detent mechanism on the shift lever which provides a noticeable indication to the child that the lever is in its precise neutral position.

In winch mechanisms having a gear train transmission movable between wind, unwind and neutral positions, movement of the transmission to its neutral position may result in free falling of an object at the end of the winch cord under the influence of gravity. This problem is eliminated in this invention by providing a fixed gear tooth that meshes with the gear train on the transmission in its neutral position for braking the gear train and drum. Accordingly, free wheeling of the gear train and free falling of the object under the force of gravity is eliminated.

The invention and its advantages will become more apparent from the detailed description of the invention presented below.

BRIEF DESCRIPTION OF THE DRAWINGS

The details of this invention will be described in connection with the accompanying drawings, in which.

DETAILED DESCRIPTION OF THE INVENTION

Figure 1:
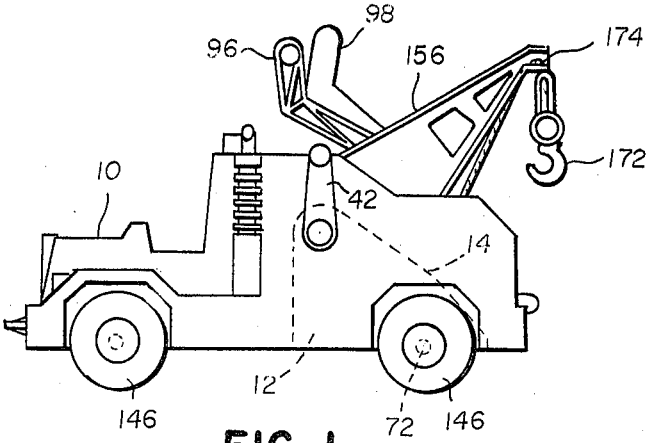
FIG. 1 is a side elevational view of a toy vehicle in which a preferred embodiment of an inertia flywheel drive mechanism of this invention is incorporated in phantom.

Referring to FIG. 1, a toy vehicle 10 such as a tow truck is disclosed in which an inertia flywheel drive mechanism 12 constructed in accordance with a preferred embodiment of this invention is incorporated.

Figure 2:
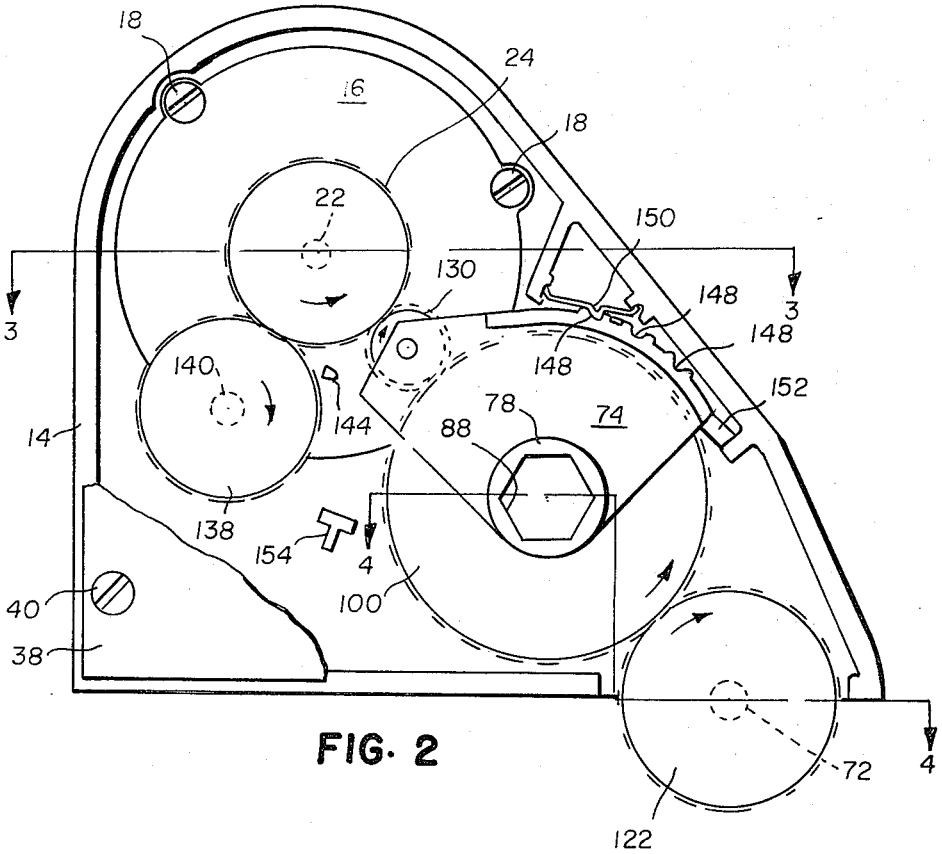
FIG. 2 is an enlarged side elevational view of the inertia flywheel drive mechanism of FIG. 1 with portions of the outer cover removed.
Figure 3:
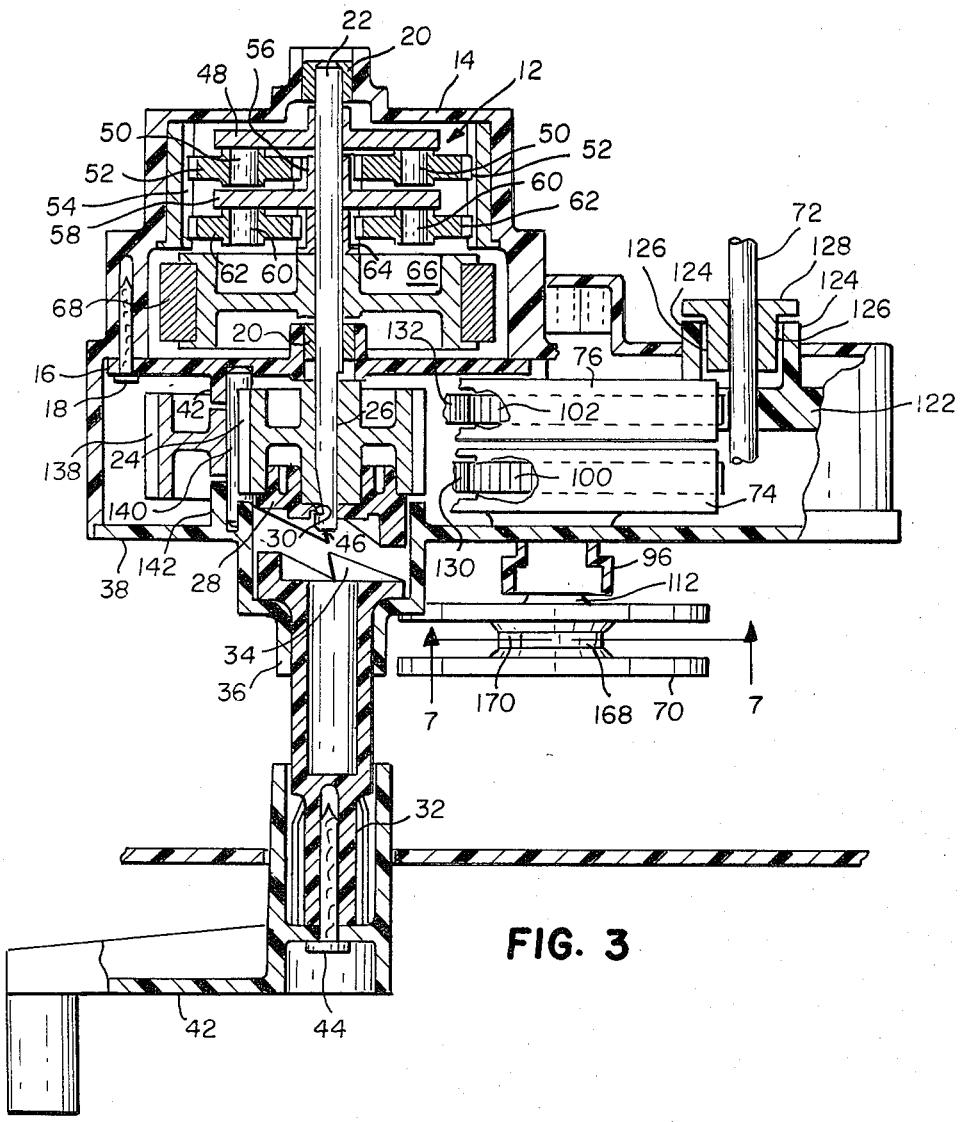
FIG. 3 is a section view taken substantially along line 3—3 of FIG. 2.
Figure 4:
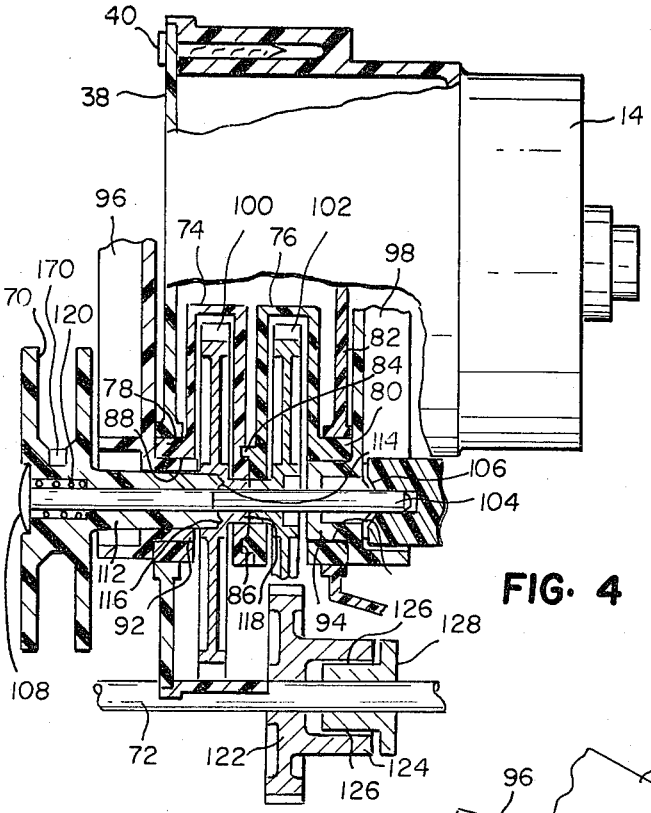
FIG. 4 is a section view taken substantially along line 4—4 of FIG. 2.

With reference to FIGS. 2–4, the inertia flywheel drive mechanism 12 comprises a generally cup-shaped preferably plastic housing 14 having an inner circular cover plate 16 secured thereto by nails 18 and/or screws. The housing 14 and cover plate 16 have axial bores within which bearings 20 are mounted for rotatably supporting a drive shaft 22. A drive gear 24 is mounted on the end of the drive shaft extending past the cover plate, and is keyed thereto by a flattened portion 26 of the shaft extending through a correspondingly shaped axial opening in the drive gear. The drive gear 24 is secured to drive shaft 22 by an end plate 28 pressed onto the drive gear and secured to the drive shaft by a detent 30.

The mechanism for imparting rotation to drive shaft 22 and drive gear 24 comprises a stub shaft 32 having ratchet teeth 34 at one end thereof. The stub shaft 32 is journaled for rotation in an axial sleeve 36 on an outer cover plate 38 secured to housing 14 by nails 40 and/or screws. The opposite end of stub shaft 32 is preferably non-circular and extends into a corresponding opening in a crank 42. The crank is secured to stub shaft 32 by a screw 44. The stub shaft 32 is axially movable causing ratchet teeth 34 to engage ratchet teeth 46 on end plate 28 for imparting counter-clockwise rotation to drive shaft 22 and drive gear 24 upon rotation of crank 42. If desired, the ratchet teeth orientation can be reversed for imparting clockwise rotation to the drive shaft and gear.

The inertia mechanism for imparting continued counter-clockwise rotation to drive shaft 22 and drive gear 24 after cranking is terminated will now be described. The inertia mechanism comprises a planetary gear system having a circular drive plate 48 secured to or integral with drive shaft 22. The plate has diametrically opposed, laterally extending spindles 50 for rotatably supporting planetary pinion gears 52. The gears 52 mesh with a ring gear 54 fixed to housing 14 by any suitable means. Gears 52 further mesh with an axially extending gear 56 integral with an intermediate drive plate 58 rotatably mounted on drive shaft 22. Drive plate 58 also has diametrically opposed, laterally extending spindles 60 for rotatably supporting pinion gears 62. Gears 62 also mesh with fixed ring gear 54 and an axially extending gear 64 integral with a circular preferably plastic cage 66 within which a cylindrical metal inertia flywheel 68 is secured. Accordingly, initial rotation of crank 42 in a counter-clockwise direction at a predetermined revolutions per minute (RPM) will impart, via the planetary gear system, rotation to the inertia flywheel 68 of a much higher RPM. When the cranking is discontinued, the inertia flywheel 68 continues its high velocity rotation for imparting through the planetary gear system continued rotation of drive shaft 22 and drive gear 24 in its counter-clockwise direction.

The power generated by inertia flywheel 68 is transmitted by a pair of side-by-side gear transmissions to a winch drum 70 for pulling or releasing a load, and a wheel shaft 72 for driving the vehicle forward or reverse. The winch and wheel shaft gear transmissions, as best seen in FIGS. 2 and 4, comprise U-shaped winch and wheel shaft cradles 74, 76 respectively having laterally outwardly extending cylindrical flanges 78, 80 pivotal within axial openings in outer cover plate 38 and a wall 82 of housing 14. The cradles 74, 76 are in abutting relation and supported for relative pivotal movement on their abutting inner walls by a ring 84 on one cradle wall nesting within an annular groove 86 on the other cradle wall. The cradle flanges 78, 80 further have axially aligned hexagonal openings 88, 90 extending therethrough for receiving complementary hexagonal rings 92, 94 laterally extending from one of the ends of winch and drive wheel shift levers 96, 98 respectively. This joins the shift levers to the cradles such that pivotal movement of the shift levers will pivotally move the cradles relative to one another.

The cradles 74, 76 partially encircle winch and wheel drive gears 100, 102 respectively which are rotatably mounted on a transmission shaft 104. The shaft extends through the center of shift lever rings 92, 94 and has a lock ring 106 at one end. The opposite end of shaft 104 has a head 108 and rotatably supports winch drum 70 having an axial stub shaft 112 journaled in the opening in shift lever ring 92.

The drive connection between winch drum 70 and winch gear 100 is achieved by a clutch comprising projections 114 on the end of the winch drum stub shaft 112 engaging complementary indentations 116 in an annular surface 118 on the core of winch gear 100. An expansion helical spring 120 mounted in an annular space between shaft 104 and winch drum 70 urges the hub projections 114 into engagement with the gear core indentations 116 with a predetermined friction force. However, if winch drum 70 is prevented from rotating for any reason, the spring force is overcome and winch gear 100 will slip relative to drum 70.

The drive connection between wheel drive gear 102 and wheel shaft 72 is achieved by a gear 122 rotatably mounted on the wheel shaft and in meshing engagement with wheel drive gear 102. Gear 122 has laterally extending spring fingers 124 bearing against flat surfaces 126 of a non-circular clutch member 128 secured to wheel shaft 72 by a key or the like. If for any reason wheel shaft 72 is prevented from rotation, spring fingers 124 will flex allowing gear 122 to rotate relative to the wheel shaft.

The cradles 74, 76 further rotatably support winch and drive wheel pinion gears 130, 132 in meshing engagement with the winch and drive wheel gears 100, 102 respectively. The pinion gears 130, 132 are rotatably mounted on shafts extending between and secured to the walls of the cradles. The winch pinion gear 130, as best seen in FIG. 2, is movable by cradle 74 and shift lever 96 into wind, unwind and neutral positions. The drive wheel pinion gear 132 (FIG. 4) is separately movable by cradle 76 and shift lever 98 into forward, reverse and neutral positions. In the winch wind position shown in full lines in FIG. 2, winch pinion gear 130 meshes with drive gear 100 which drives winch hub (FIG. 4) in a counter-clockwise direction for winding a cord 110 attached thereto. In the winch unwind position, pinion gear 130 meshes with a driven idler gear 138 in mesh with main drive gear 24 for driving winch drum 70 in a clockwise direction. Idler gear 138 is rotatably mounted on a shaft 140 (FIG. 2) journaled in bearings 142 on the inner and outer cover plates 16, 38 as best seen in FIG. 3. In the neutral position, pinion gear 130 is disengaged from the drive and idler gears 24, 138. In this neutral position, a fixed gear tooth 144 extending laterally from cover plate 38 meshes with the pinion gear 130 for locking or braking the gear to prevent winch drum 70 from unwinding or free-wheeling if the winch drum is subjected to a torque due to a load on the winch cord.

In the drive wheel reverse position, drive wheel pinion gear 132 (FIG. 4) meshes with drive gear 24 which drives drive wheel pinion gear 132 (FIG. 3), gear 102 and gear 122 for driving wheel shaft 72 and wheels 146 secured thereto in a clockwise direction for moving the vehicle in a reverse direction. In the drive wheel forward position, drive wheel pinion gear 132 meshes with idler gear 138 for driving the vehicle through gears 102, 122 in a forward direction. In the drive wheel neutral position, drive wheel pinion gear 132 is disengaged from gears 24, 138 and is free to idle in the event the vehicle wheels 146 are rotated manually.

A pair of cradle detent mechanisms are provided for precisely positioning cradles 74, 76 in their selected positions. Each of the cradle detent mechanisms, as best seen in FIG. 2, comprises peripheral spaced grooves 148 on each of the cradles for receiving a spring lug 150 biased toward the cradles. The grooves 148 and lug 150 are arranged such that each time the lug bottoms in a groove, the cradles and pinion gears 130, 132 are precisely positioned in selected ones of the winch and drive wheel operating positions. A pair of stop posts 152, 154 are provided on housing 14 for limiting the range of pivotal movement of the cradles 74, 76 to prevent damage to or jamming of the cradles, pinion gears 130, 132, drive gears 100, 102 and idler gear 138.

Figure 6:
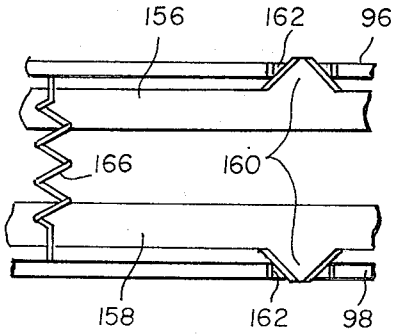
FIG. 6 is a segmental view of the detents of FIG. 5 taken substantially from line 6—6 of FIG. 5.
Figure 5:
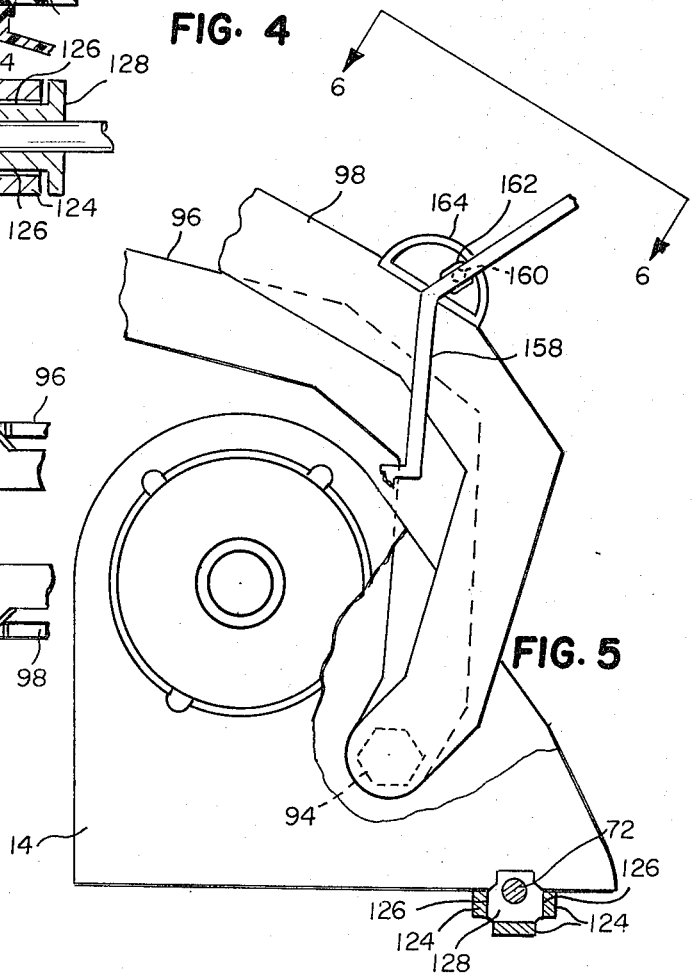
FIG. 5 is an enlarged segmental view of the toy vehicle of FIG. 1 showing the shift levers and detents for releasably holding the levers in their neutral positions.

Another pair of detent mechanisms are interposed between shift levers 96, 98 and fixed projecting boom members 156, 158 on the toy vehicles, as best seen in FIGS. 5 and 6, to prevent the child from overshooting the neutral position. Each shift lever detent mechanism comprises a V-shaped projection 160 on the boom member adapted to nest in an elongated slot 162 in a semi-circular flange 164 extending from each shift lever 96, 98. A spring 166 interconnects the shift levers and urges them toward the projections 160. Since the shift lever force arm (distance between the shift lever pivot and point on the shift lever where force is applied to shift the lever) is considerably greater than the cradle detent force arm (distance between the cradle pivot and cradle detent grooves), it is easy for a child to move a shift lever past the cradle detent neutral position with little effort. The shift lever detents 160, 162 eliminate this problem since the child can feel and respond to the shift lever neutral position and not overshoot it. The precise positioning of the cradle and pinion gears 130, 132 is achieved, however, by the cradle detent mechanism 148, 150.

Figure 7:
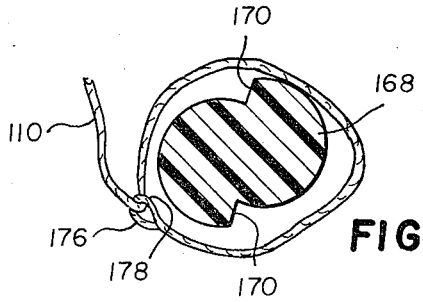
FIG. 7 is a section view taken substantially along line 7—7 of FIG. 3.

With reference to FIG. 7, winch drum 70 is provided with a non-circular hub 168 in which the periphery thereof has at least one radially extending shoulder 170. The winch drum cord 110 has one end secured to a hook 172 (FIG. 1) which can be secured to any suitable object that is to be pulled or lifted. Normally the intermediate portion of the cord passes over a pulley 174 supported at the free ends of the vehicle projecting boom members 156, 158. The other end of the cord 110 has a loop 176, and the looped end encircles the hub with the intermediate portion of the cord threaded through the loop. When the cord tightens around the hub, the cord forms a knot 178 at the loop. Accordingly, when winch drum 70 is driven with winch shift lever 96 in its wind position, the hub shoulder 170 engages the loop knot 178 and winds the cord around the hub. When the winch shift lever is moved into its unwind position, the winch drum is driven in the opposite direction unwinding the cord and lowering the object. When the end or looped knot of the cord is reached with the object at its lowermost position, the hub shoulder slips over the knot upon continued unwinding rotation of the winch drum so that the cord is not wound onto the hub in the opposite direction. This assures that in the winch unwind position, no winding of the cord can take place.

While a presently preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy vehicle comprising:

a ground engaging drive wheel selectively rotatable in opposite directions for driving the vehicle in forward and reverse directions;

winch means comprising a drum selectively rotatable in opposite directions for winding or unwinding a cord;

an inertia flywheel for driving said drive wheel and said winch means;

a main drive gear coupled to said flywheel;

means coupled to said main drive gear and flywheel for rotating said main drive gear and flywheel in only one direction;

first transmission means pivotal on a shaft for coupling said rotating main drive gear to said drive wheel for driving the vehicle in one of said forward and reverse directions; and second transmission means pivotal on said shaft for coupling said rotating main drive gear to said winch means for winding or unwinding the cord.

2. A toy vehicle according to claim 1 wherein said drum has a hub having a substantially radial shoulder on its periphery.

3. A toy vehicle according to claim 1 wherein said flywheel rotating means comprises a crank, and a planetary gear train coupling said crank to said flywheel.

4. A toy vehicle according to claim 1 wherein said drum is rotatable on said shaft, and said second transmission means comprises a first cradle pivotal about said shaft, a winch drive gear enclosed within said first cradle and rotatable about said shaft, and a slip clutch interposed between said drum and said winch drive gear to impart a predetermined torque to said drum to allow relative movement between said drum and winch drive gear in the event the drum is held by a torque exceeding said predetermined torque.

5. A toy vehicle according to claim 4 wherein said first transmission means comprises a second cradle pivotal about said shaft, and a wheel drive gear enclosed within said second cradle and rotatable about said shaft.

6. A toy vehicle according to claim 5 wherein said first and second cradles rotatably support first and second pinion gears respectively in meshing engagement with said wheel drive and winch gears respectively, and means for selectively shifting said first and second pinion gears into and out of engagement with said main drive gear.

7. A toy vehicle according to claim 6 and further comprising a driven gear in meshing engagement with said main drive gear, said shifting means comprises first and second movable levers for selectively shifting said first and second pinion gears between first positions in meshing engagement with said main drive gear, second positions in meshing engagement with said driven gear, and neutral positions out of engagement with said main drive and driven gears, and first and second detent means for precisely positioning each of said first and second pinion gears in said neutral positions.

8. A toy vehicle according to claim 7 wherein said first detent means is coupled to said first and second cradles, and said second detent means is coupled to said first and second levers.

9. A toy vehicle according to claim 8 wherein said first detent means comprises grooves on said first and second cradles, and resilient lugs engageable with said grooves, and said second detent means comprises a slot in each of said first and second levers, and a fixed projection seatable within each of said slots.

10. A toy vehicle according to claim 9 and further comprising a spring coupling together said first and second levers for urging said levers toward said fixed projections.

11. A toy vehicle according to claim 6 and further comprising a fixed gear tooth engageable by said second pinion gear for braking said winch drum when said second pinion gear is out of engagement with said main drive gear.

12. A toy vehicle according to claim 6 and further comprising a driven gear in meshing engagement with said main drive gear, said shifting means comprises first and second movable levers for selectively shifting said first and second pinion gears respectively between said first positions in meshing engagement with said main drive gear, and neutral positions out of engagement with said main drive and driven gears, and a fixed gear tooth engageable by said second pinion gear for braking said winch drum when said second pinion gear is in its neutral position.

* * * * *